United States Patent [19]

Deland

[11] Patent Number: 4,505,239

[45] Date of Patent: Mar. 19, 1985

[54] INTERNAL COMBUSTION ENGINE

[76] Inventor: Olivier Deland, 821 Normandie No. 18, St. Jean, Quebec, Canada, J3A 1K6

[21] Appl. No.: 587,691

[22] Filed: Mar. 8, 1984

[51] Int. Cl.[3] ..... F02B 75/32

[52] U.S. Cl. ..... 123/197 AC; 92/187; 123/78 F; 123/54 B

[58] Field of Search ..... 123/48 R, 48 B, 51 R, 123/51 B, 51 BA, 51 AA, 51 A, 54, 78 R, 78 F, 197 R, 197 AB, 197 AC; 92/187

[56] References Cited

U.S. PATENT DOCUMENTS

| | | | |
|---|---|---|---|
| 800,659 | 10/1905 | Korsmeyer | 123/54 B |
| 1,379,115 | 5/1921 | Mallory | 123/197 A |
| 1,384,343 | 7/1921 | Powell | 123/54 R |
| 1,518,334 | 12/1924 | McMaster | 123/197 A |

FOREIGN PATENT DOCUMENTS

| | | | |
|---|---|---|---|
| 112866 | 4/1929 | Austria | 123/78 F |
| 1011422 | 6/1952 | France | 123/197 AC |
| 1207362 | 2/1960 | France | 123/197 AC |

*Primary Examiner*—Craig R. Feinberg
*Attorney, Agent, or Firm*—Alan Swabey; Robert Mitchell; Guy J. Houle

[57] ABSTRACT

The invention relates to an engine including a cylinder defining a combustion chamber which receives a mixture for combustion thereof, and a piston slidably mounted therein for reciprocation between a first and a second limit position whereat the chamber defines its minimum and maximum volume, respectively. A pair of rotatably mounted parallel crankshafts are arranged equidistantly relative to the longitudinal axis of the cylinder, each having a crankarm rotatable about its respective crankshaft axis. Coupling means connect the crankshaft together for synchronising rotation thereof with the crankarm of one crankshaft having an angular advance over the crankarm of the other crankshaft. A rocker member pivotally connected to the piston for rocking movement about a pivot axis extends normal to the longitudinal axis of the cylinder, and a pair of connecting rods interconnect the rocker member and the respective crankarms of the crankshafts with each connecting rod being pivotally connected to the member. The rocker member with the connecting rods define a position control means for enabling the member to rock when the piston reaches the first position to maintain the piston substantially stationary at this position for a time sufficient permitting the crankarm of the aforesaid one crankshaft past dead-center. Substantially maximum compression is achieved in the combustion chamber during compression of the piston when it is at the first position while the crankarm of the aforesaid one crankshaft is positioned past dead-center whereupon combustion of the mixture maximum thrust is imparted to the piston.

12 Claims, 6 Drawing Figures

INTERNAL COMBUSTION ENGINE

BACKGROUND OF THE INVENTION

The present invention relates to improvements in internal combustion engines. More particularly, the invention is concerned with an improved connecting rod and crank-shaft arrangement in an internal combustion engine.

In conventional internal combustion engines, the crank-shaft is usually arranged below a cylinder in a manner such that the longitudinal axis of the cylinder and the crank-shaft axis lie in a common plane. Thus, when a vertically reciprocating piston which is connected to a crank-arm of the crank-shaft by means of a connecting rod reaches its uppermost position, a dead-center occurs, that is, a line passing through the points of connection of the rod to the piston and crank-arm intersects the crank-shaft axis. It has therefore been the practice to time the ignition so that combustion takes place when the crank-arm has moved past dead-center and is at an angular position relative to the longitudinal axis of the cylinder. As a result, there is a loss of compression in the combustion chamber defined in the cylinder such that upon combustion maximum thrust cannot be imparted to the piston. In addition, since the connecting rod is angularly inclined relative to the longitudinal axis of the cylinder when the piston is intermediate its uppermost and lowermost positions, there is a problem of friction occurring between the piston and the cylinder wall.

In U.S. Pat. Nos. 1,414,987 and 2,130,529, it has been proposed to arrange the crank-shaft offset from the longitudinal axis of the cylinder. However, such an arrangement does not overcome the drawback of having a dead-center occurring when maximum compression is achieved in the combustion chamber since, when the piston reaches its uppermost position, the line passing through the connection points of the connecting rod to the piston and crank-arm still intersects the crank-shaft axis. Moreover, owing to the eccentric position of the crank-shaft, excessive friction occurs between the piston and the cylinder wall on the side of the cylinder opposite the crank-shaft.

SUMMARY OF THE INVENTION

It is therefore an object of the present invention to overcome the aforementioned drawbacks and to provide an internal combustion engine having an improved connecting rod and crank-shaft arrangement enabling maximum compression to be achieved in the combustion chamber without a dead-center occurring.

It is a further object of the invention to eliminate or at least reduce the friction exerted between the piston and the cylinder wall in an internal combustion engine.

In accordance with the present invention, there is provided in an internal combustion engine including a cylinder defining a combustion chamber adapted to receive a combustible mixture for the combustion thereof, and a piston slidably mounted in the cylinder for reciprocating movement between a first limit position whereat the combustion chamber defines its minimum volume and a second limit position whereat the combustion chamber defines its maximum volume, the improvement comprising a pair of rotatably mounted parallel crank-shafts arranged equidistantly relative to the longitudinal axis of the cylinder and each having a crank-arm rotatable about its respective crank-shaft axis, and means coupling the crank-shafts together for synchronising the rotation thereof with the crank-arm of one of the crank-shafts having an angular advance over the crank-arm of the other crank-shaft. A rocker member is pivotally connected to the piston for rocking movement about a pivot axis extending normal to the longitudinal axis of the cylinder. A pair of connecting rods interconnect the rocker member and the respective crank-arms of the crank-shafts with each connecting rod being pivotally connected to the rocker member. The rocker member together with the connecting rods define a position control means for enabling the rocker member to rock when the piston reaches the first limit position and to thereby maintain the piston substantially stationary at the first limit position for a period of time sufficient to permit the crank-arm of the aforesaid one crank-shaft to move past dead-center.

Thus, substantially maximum compression is achieved in the combustion chamber during a compression stroke of the piston when the piston is at the first limit position while the crank-arm of the aforesaid on crank-shaft is positioned past dead-center such that upon combustion of the combustible mixture maximum thrust is imparted to the piston.

Due to the provision of two crank-shafts and two connecting rods indirectly connecting the crank-arms of the crank-shafts to the piston via a rocker member, and by giving to the crank-arm of one crank-shaft an angular advance over the crank-arm of the other crank-shaft, it is now possible in accordance with the invention to control the occurrence of dead-centers so as to achieve maximum compression when the piston is at the first limit position while the crank-arm which is given an angular advance is positioned past dead-center. Moreover, since the crank-shafts are disposed equidistantly relative to the longitudinal axis of the cylinder, there is substantially no friction exerted between the piston and the cylinder wall.

According to a preferred embodiment of the invention, the angular position of the crank-arm which is given an angular advance is adjusted so that when the piston is at the first limit position and combustion takes place, such crank-arm is positioned at an angle of about 30° past dead-center. Preferably, the angular position of the crank-arm of the other crank-shaft is also adjusted so that when the same event occurs it is positioned past dead-center, for example at an angle of about 10°.

The invention enables to increase the efficiency of internal combustion engines, thus providing a greater power output. An internal combustion engine constructed in accordance with the invention may be a single cylinder engine as in the case of lawn mowers or a multicylinder engine as in the case of land vehicles, aircrafts and the like, and can function either on the diesel principle or on the two or four cycle principle.

BRIEF DESCRIPTION OF THE DRAWINGS

Further features and advantages of the invention will become more readily apparent from the following description of a preferred embodiment thereof as illustrated by way of example in the accompanying drawings, wherein.

DESCRIPTION OF PREFERRED EMBODIMENTS

Figure 2:
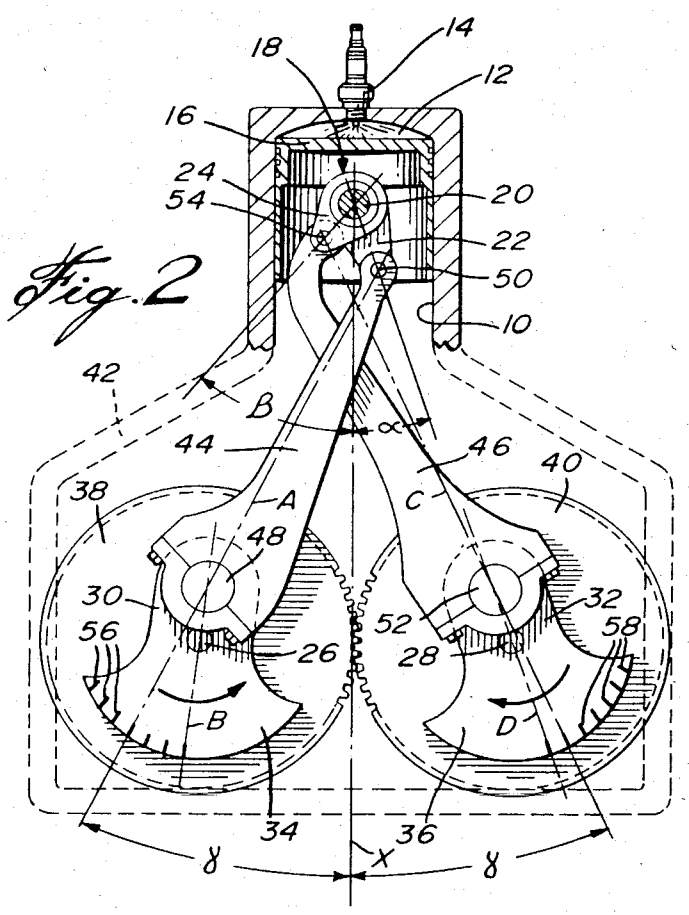
FIGS. 1 to 5 are part-sectioned elevational views taken through an internal combustion engine constructed in accordance with the invention, showing the inner parts thereof during the various phases of their movements.

Referring to the drawings, there is illustrated an internal combustion engine having a cylinder 10 defining at its top a combustion chamber 12 adapted to receive through an intake valve (not shown) a combustible mixture for the combustion thereof, the spark plug 14 serving to ignite the combustible mixture. A piston 16 is slidably mounted in the cylinder 10 for vertical reciprocating movement. A rocker member 18 is pivotally connected to the piston 16 by means of the wrist pin 20 for rocking movement relative to the longitudinal axis X of the cylinder 10. The rocker member 18 is provided with a pair of fixed arms 22 and 24 which extend radially from the pivot axis defined by the wrist pin 20 and have different radial lengths, the arm 22 being longer than the arm 24. The arms 22 and 24 are angularly inclined relative to one another with an angle of about 60° being defined therebetween.

A pair of rotatably mounted parallel crank-shafts 26 and 28 having respective crank-arms 30 and 32 and respective counterweights 34 and 36 are arranged equidistantly relative to the longitudinal axis X of the cylinder 10. The crank-shafts 26 and 28 are coupled together by gear wheels 38 and 40 having a gear ratio of 1:1 and being in meshing engagement with each other to cause the crank-shafts to rotate in opposite directions. The gear wheels 38 and 40 which are fixedly connected at their respective centers to the crank-shafts 26 and 28 may be located exteriorily of the crankcase 42.

A pair of connecting rods 44 and 46 having different lengths interconnect the rocker member 18 and the respective crank-arms 30 and 32 of the crank-shafts 26 and 28, and are arranged so as to cross each other. As shown, the shorter connecting rod 44 is pivotally connected at its lower end to the crank-arm 30 by means of the crank-pin 48 and at its upper end to the longer arm 22 of the rocker member by means of a pivot pin 50. On the other hand, the longer connecting rod 46 is pivotally connected at its lower end to the crank-arm 32 by means of the crank-pin 52 and at its upper end to the shorter arm 24 of the rocker member by means of a pivot pin 54.

The angular position of the crank-arm 30 relative to the reference line A intersecting the pivot axes defined by the crank-pin 48 and pivot pin 50 is represented by the line B which intersects the rotation axis of the crank-shaft 26 and the pivot axis defined by the crank-pin 48. Similarly, the angular position of the crank-arm 32 relative to the reference line C intersecting the pivot axes defined by the crank-pin 52 and pivot pin 54 is represented by the line D which intersects the rotation axis of the crank-shaft 28 and the pivot axis defined by the crank-pin 52. For the sake of simplicity and in order to easily determine the angles between the lines A and B and the lines C and D, a plurality of equally spaced-apart markings 56 and 58 are provided on the counterweights 34 and 36, respectively, the space between two consecutive markings 56 or 58 corresponding to an angle of about 10°. Thus, when the lines A and B or the lines C and D coincide with each other, that is, the angle defined therebetween is 0°, a dead-center occurs.

In order to avoid the occurrence of a dead-center when the piston 16 is at its uppermost position, the crank-arm 30 is given an angular advance over the crank-arm 32. In other words, the angular position of the crank-arm 30 is adjusted by means of the gear wheel 38 prior to its coupling to the gear wheel 40 so that when the piston 16 is at its uppermost position and combustion takes place as shown in FIG. 2, the crank-arm 30 will be positioned at an angle of, for example, 30° past dead-center, i.e., the line B will define an angle of 30° relative to the reference line A. As shown, the crank-arm 32 is also adjusted so that when the same event occurs it will be positioned past dead-center, for example at an angle of about 10° which corresponds to the angle defined between lines C and D.

Figure 1:
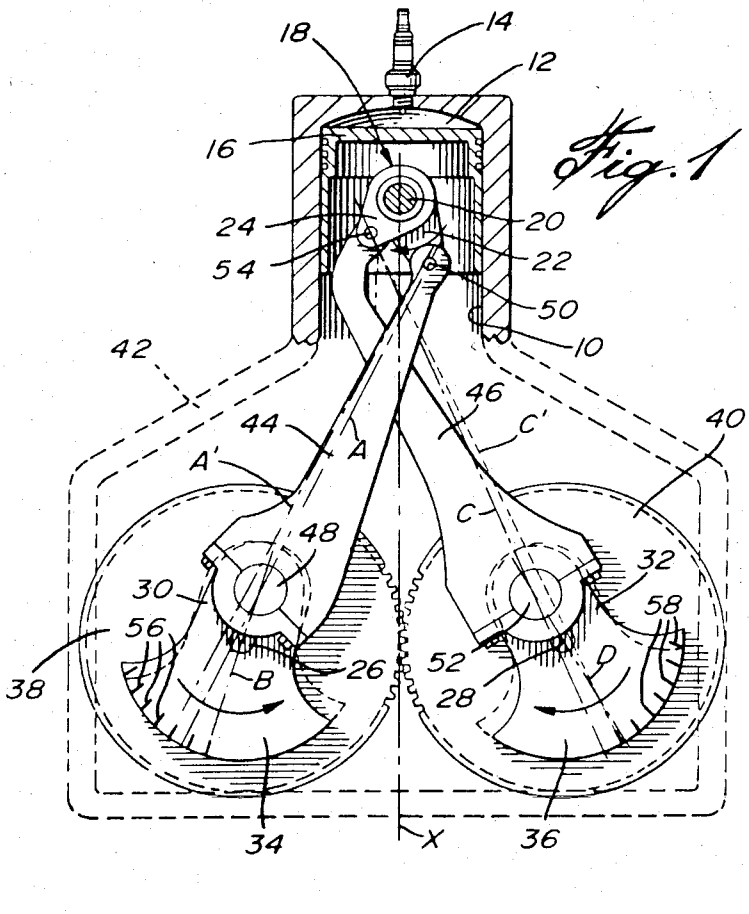

Turning now to the operation of the internal combustion engine illustrated, FIG. 1 shows how the rocker member 18 moves in response to the displacement of the connecting rods 44 and 46 when the piston 15 reaches its uppermost position. As the crank-shaft 26 rotates counterclockwise and the crank-shaft 28 rotates clockwise, the connecting rods 44 and 46 move from their respective positions represented by lines A and C to the positions represented by lines A′ and C′. As a result, the connecting rod 44 exerts a pulling force on the arm 22 of the rocker member 18 while the connecting rod 46 exerts a pushing force on the arm 24, which cause the rocker member 18 to pivot about the wrist-pin 20 in the direction shown by the arrow in FIG. 1. This rocking movement of the member 18 enables the piston 16 to remain substantially stationary at its uppermost position while the crank-arms 30 and 32 are allowed to move to the positions represented in broken lines in FIG. 1, which correspond to the positions shown in FIG. 2, that is, past dead-center. The connecting rod 46 is curved adjacent its upper end to provide a clearance for the arm 22 of the rocker member 18 during the rocking movement thereof.

As shown in FIG. 2, when the combustible mixture in the combustion chamber 12 is ignited by means of the spark plug 14 and combustion takes place, the piston 16 is still at its uppermost position whereas the crank-arm 30 is at an angular position of about 30° relative to reference line A and the crank-arm 32 at an angular position of about 10° relative to reference line C; in other words, the crank-arms 30 and 32 are positioned past dead-center by an angle of 30° and 10°, respectively. Thus, maximum compression is maintained in the combustion chamber 12 so that upon combustion of the combustible mixture maximum thrust is imparted to the piston 16. On the other hand, the arm 22 of the rocker member 18 defines an angle $\alpha$ of about 35° relative to the axis X and the arm 24 an angle $\beta$ of about 25°. The connecting rod angle $\gamma$ which is defined between the reference line A or B and the axis X is approximately 27°; due to such a relatively high angle, the connecting rods 44 and 46 offer much less resistance to the downward force exerted on the piston 16 upon combustion than in conventional engines.

Figure 3:
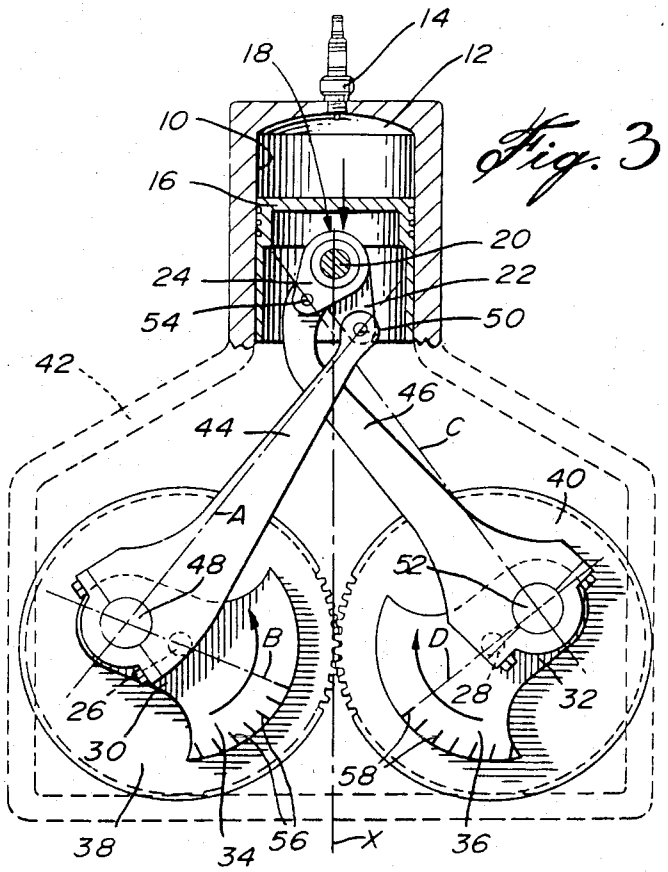

FIG. 3 illustrates the relative positions of the engine parts as the piston 16 moves downwardly after the combustion has taken place. As shown, the crank-arm 30 clearly has an advance over the crank-arm 32.

Figure 4:
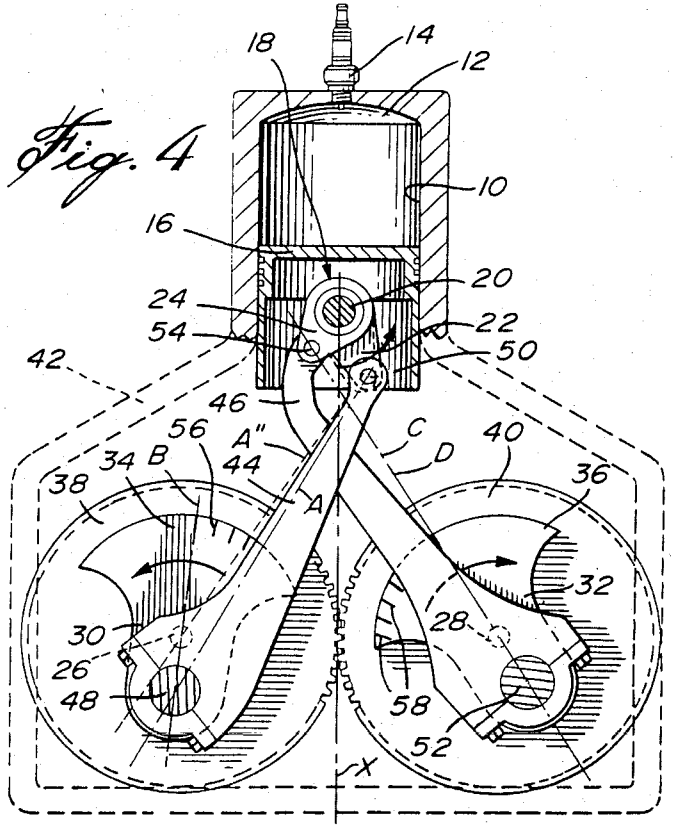
Figure 5:
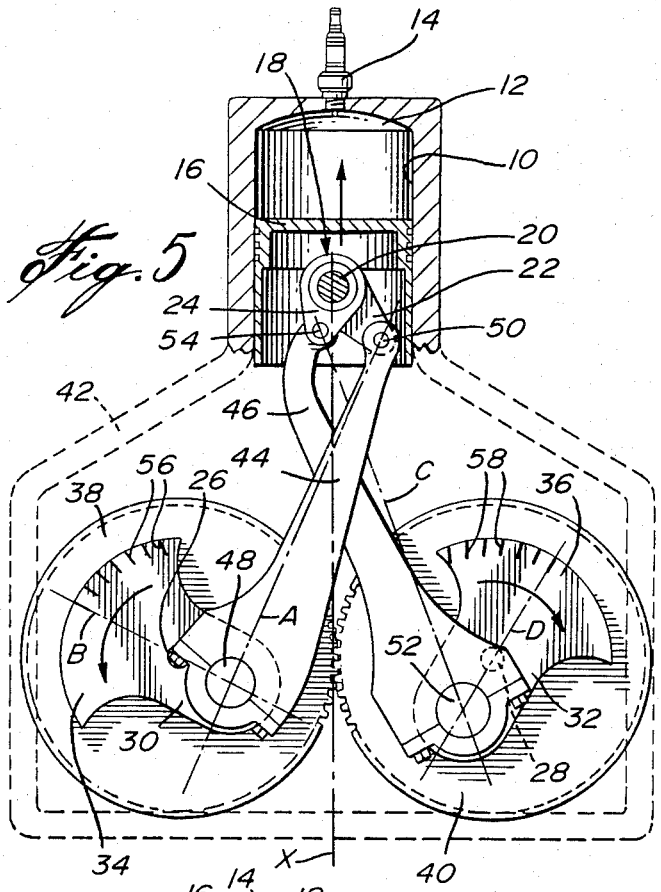

FIG. 4 shows the piston 16 in its lowermost position and the rocking movement of the rocker member 18 in the direction indicated by the arrow, as a result of the movement of the connecting rod 44 from the position represented by line A to the position represented by line A″. After such a rocking movement of the rocker member 18, during which the piston 16 remains substantially stationary similarly as in FIG. 1, the piston 16 then moves upwardly as shown in FIG. 5.

Figure 6:
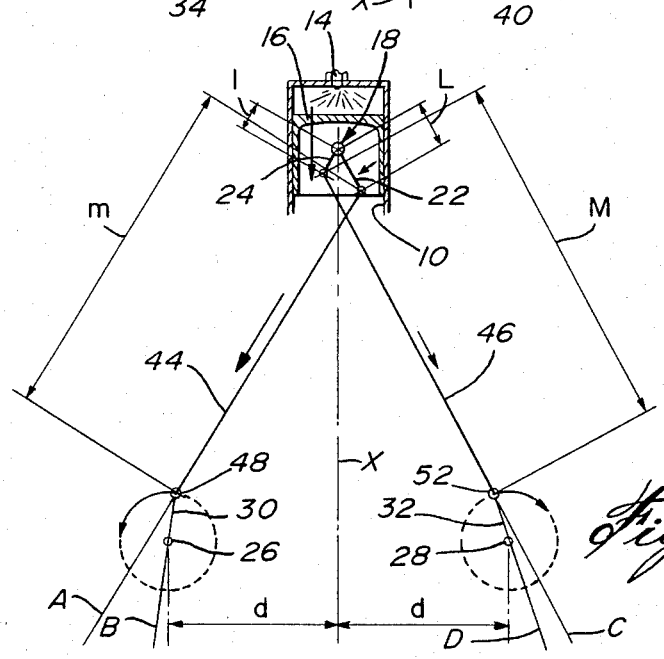
FIG. 6 is a schematic representation showing the relative position of the engine parts when combustion takes place.

In FIG. 6 which is a schematic representation of FIG. 2, showing the relative positions of the engine parts when combustion takes place, the lengths of the arms 22 and 24 of the rocker member are designated by the letters l and L and the lengths of the connecting rods 44 and 46 by the letters m and M. As shown, the lengths L and M are greater the lengths l and m, respectively. Owing to the angular position of the arm 22 which as previously mentioned defines an angle $\alpha$ smaller than the angle $\beta$ defined by the arm 24 relative to the axis X (see FIG. 2), the force which is transmitted by the piston 16 to the connecting rod 44 is greater compared to that transmitted to the connecting rod 46. It will also be seen that the crank-shafts 26 and 28 are each spaced from the longitudinal axis X of the cylinder 10 by the same distance d and thus substantially no friction is exerted between the piston 16 and the cylinder wall.

I claim:

1. In an internal combustion engine including a cylinder defining a combustion chamber adapted to receive a combustible mixture for the combustion thereof, and a piston slidably mounted in said cylinder for reciprocating movement between a first limit position whereat the combustion chamber defines its minimum volume and a second limit position whereat the combustion chamber defines its maximum volume, the improvement comprising a pair of rotatably mounted parallel crank-shafts arranged equidistantly relative to the longitudinal axis of said cylinder and each having a crank-arm rotatable about its respective crank-shaft axis, means coupling said crank-shafts together for synchronising the rotation thereof with the crank-arm of one of said crank-shafts having an angular advance over the crank-arm of the other crank-shaft, a rocker member pivotally connected to said piston for rocking movement about a pivot axis extending normal to the longitudinal axis of said cylinder, and a pair of connecting rods interconnecting said rocker member and the respective crank-arms of said crank-shafts with each said connecting rod being pivotally connected to said rocker member, said rocker member together with said connecting rods defining a position control means for enabling said rocker member to rock when said piston reaches said first limit position and to thereby maintain said piston substantially stationary at said first limit position for a period of time sufficient to permit the crank-arm of said one crank-shaft to move past dead-center, whereby substantially maximum compression is achieved in said combustion chamber during a compression stroke of said piston when said piston is at said first limit position while the crank-arm of said one crank-shaft is positioned past dead-center such that upon combustion of said combustible mixture substantially maximum thrust is imparted to said piston.

2. An internal combustion engine as claimed in claim 1, wherein said coupling means comprise a pair of gear wheels each fixedly connected at its respective center to a respective one of said crank-shafts, said gear wheels having a gear ratio of 1:1 and being in meshing engagement with each other to cause said crank-shafts to rotate in opposite directions.

3. An internal combustion engine as claimed in claim 1, wherein said rocker member is provided with a pair of fixed arms extending radially from the pivot axis about which said rocker member rocks, said arms being angularly inclined relative to one another and each being pivotally connected at a free end thereof to a respective one of said connecting rods.

4. An internal combustion engine as claimed in claim 3, wherein the arms of said rocker member define therebetween an angle of about 60°.

5. An internal combustion engine as claimed in claim 4, wherein when said piston is at said first limit position said rocker member is moved to a position whereat one arm thereof defines an angle of about 25° relative to the longitudinal axis of said cylinder and the other arm defines an angle of about 35° relative to said longitudinal axis.

6. An internal combustion engine as claimed in claim 3, wherein the arms of said rocker member have different radial lengths, one arm being longer than the other.

7. An internal combustion engine as claimed in claim 6, wherein said connecting rods are arranged so as to cross each other, one of said connecting rods being pivotally connected at a first end thereof to the crank-arm of said one crank-shaft and at a second end thereof to said one arm of said rocker member, the other connecting rod being pivotally connected at a first end thereof to the crank-arm of said other crank-shaft and at a second end thereof to said other arm of said rocker member.

8. An internal combustion engine as claimed in claim 7, wherein said one connecting rod has a smaller length relative to said other connecting rod.

9. An internal combustion engine as claimed in claim 7, wherein said other connecting rod is curved adjacent its second end to provide a clearance for said one arm of said rocker member during the rocking movement thereof.

10. An internal combustion engine as claimed in claim 7, wherein when said piston is at said first limit position and combustion takes place the crank-arm of said one crank-shaft is at an angular position of about 30° relative to a first reference line intersecting the pivotal connections of said one connecting rod at said first and second ends thereof.

11. An internal combustion engine as claimed in claim 10, wherein when said piston is at said first limit position and combustion takes place, the crank-arm of said other crank-shaft is at an angular position of about 10° relative to a second reference line intersecting the pivotal connections of said other connecting rod at said first and second ends thereof.

12. An internal combustion engine as claimed in claim 11, wherein when said piston is at said first limit position and combustion takes place said first and second reference lines each define an angle of about 27° relative to the longitudinal axis of said cylinder.

* * * * *